United States Patent [19]

Wethington et al.

[11] 3,954,535

[45] May 4, 1976

[54] METHOD AND APPARATUS TO PRODUCE A TEXTILE PRODUCT

[75] Inventors: Charles A. Wethington, Spartanburg; Michael W. Gilpatrick, Chesnee, both of S.C.

[73] Assignee: Deering Milliken Research Corporation, Spartanburg, S.C.

[22] Filed: Mar. 29, 1974

[21] Appl. No.: 455,981

[52] U.S. Cl. ..... 156/72; 156/177; 156/435

[51] Int. Cl.[2] ..... A46D 1/00; D04H 11/08

[58] Field of Search ..... 156/72, 162, 173, 177, 156/179, 189, 204, 205, 210, 272, 429–431, 435, 443, 446, 459, 462, 468, 472–477, 489–491; 28/1.8, 72 P; 161/63

[56] References Cited

UNITED STATES PATENTS

| | | | |
|---|---|---|---|
| 1,970,625 | 8/1934 | Reed | 156/204 |
| 2,101,906 | 8/1935 | Hopkinson | 156/435 |
| 2,116,048 | 1/1938 | Smith | 156/204 |
| 2,583,337 | 1/1952 | Laing | 156/471 |
| 2,831,525 | 9/1949 | Cole | 156/471 |
| 3,132,985 | 5/1964 | Moore | 156/462 |
| 3,424,632 | 1/1969 | Adler | 156/435 |
| 3,561,133 | 2/1971 | Hauck | 219/388 |
| 3,632,984 | 1/1972 | Brownscombe | 219/388 |
| 3,701,700 | 10/1972 | Von Der Heide | 156/72 |
| 3,739,143 | 6/1973 | Amundson et al. | 219/216 |

FOREIGN PATENTS OR APPLICATIONS

| | | | |
|---|---|---|---|
| 1,560,873 | 1969 | Germany | 156/435 |

*Primary Examiner*—William A. Powell
*Assistant Examiner*—John E. Kittle
*Attorney, Agent, or Firm*—Earle R. Marden; H. William Petry

[57] ABSTRACT

Method and apparatus to produce a bonded loop pile carpet. The carpet machine is of the rotary type which uses cooperating blade members to form the yarn loops for bonding to a backing sheet. One of the blade members is reciprocably mounted in the machine and moves in a downward curved angular path to contact the yarn.

4 Claims, 8 Drawing Figures

METHOD AND APPARATUS TO PRODUCE A TEXTILE PRODUCT

It is an object of this invention to provide a method and apparatus to efficiently, inexpensively and continuously produce a bonded loop pile carpet.

Other objects and advantages of the invention will become readily apparent as the specification proceeds to describe the invention with reference to the accompanying drawings, in which.

Figure 1:
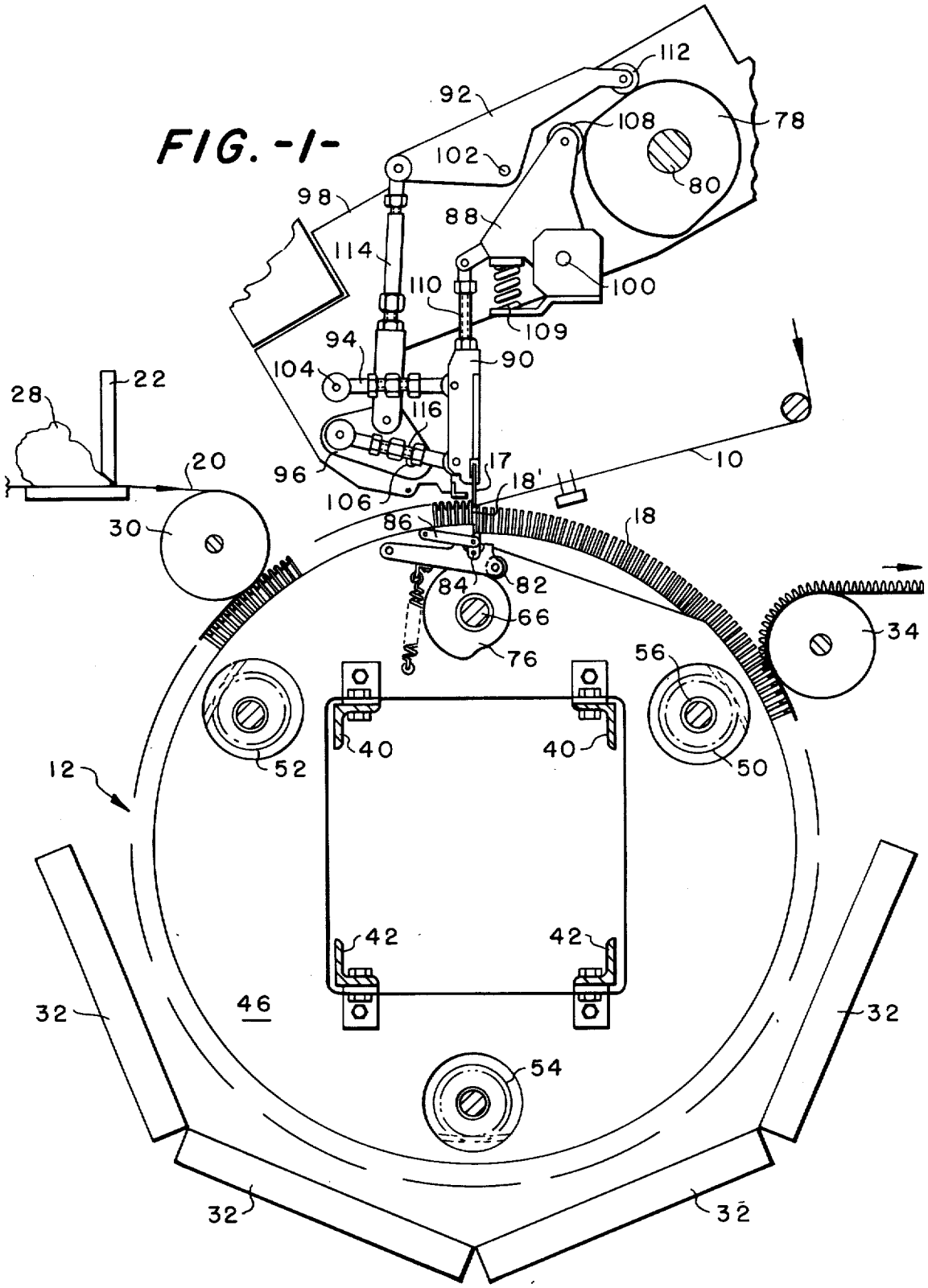
FIG. 1 is a sectional elevation view taken on line 1—1 of FIG. 2.
Figure 2:
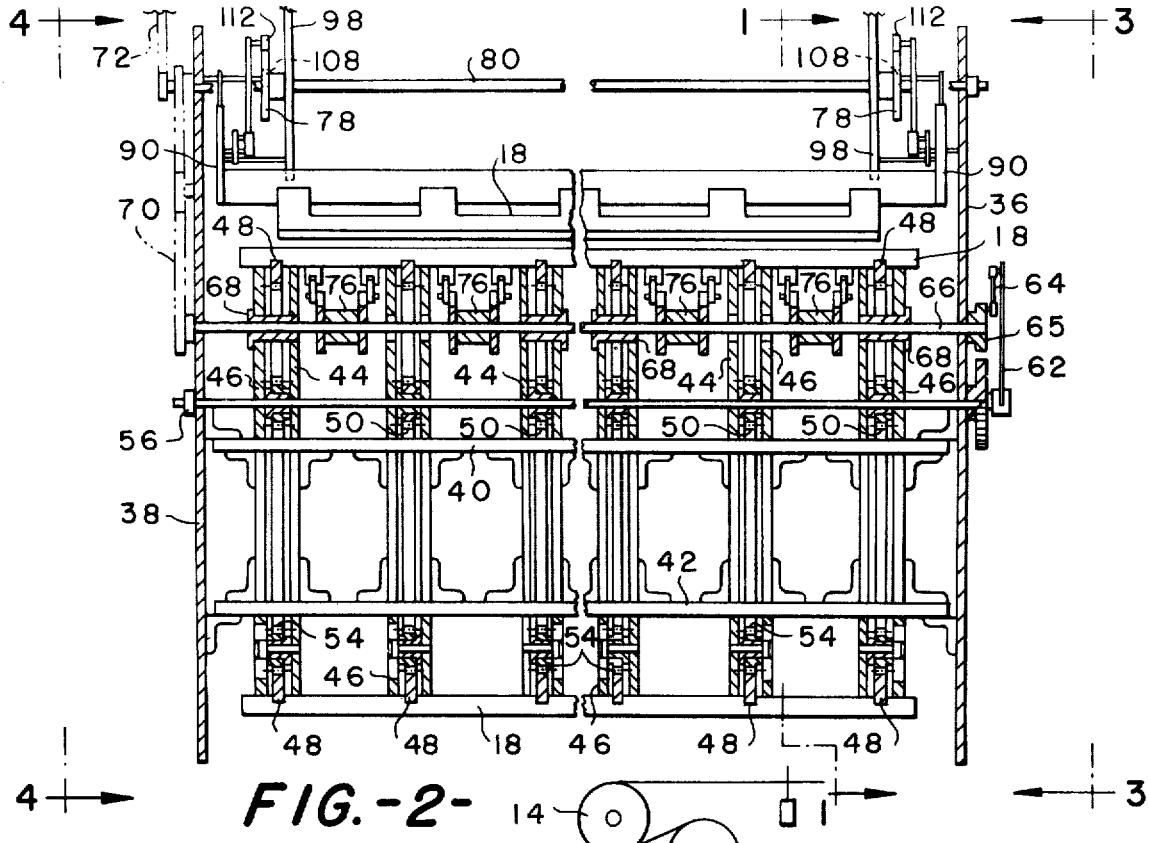
FIG. 2 is a cross-sectional elevation view of the carpet machine rotor.
Figure 5:
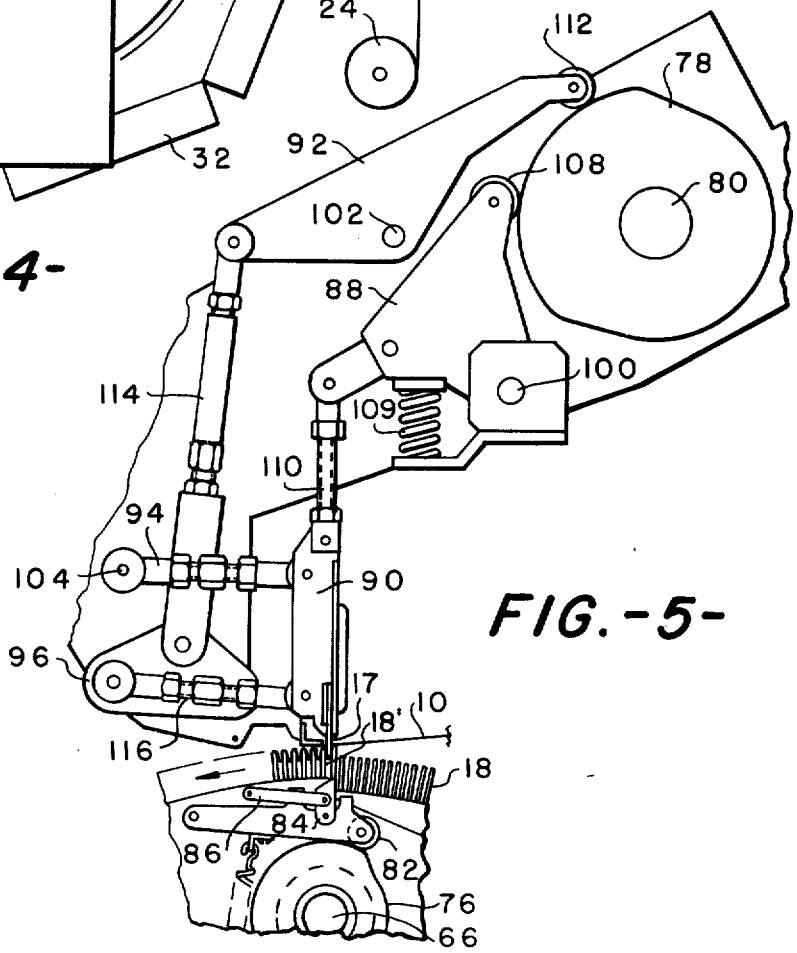
Figure 6:
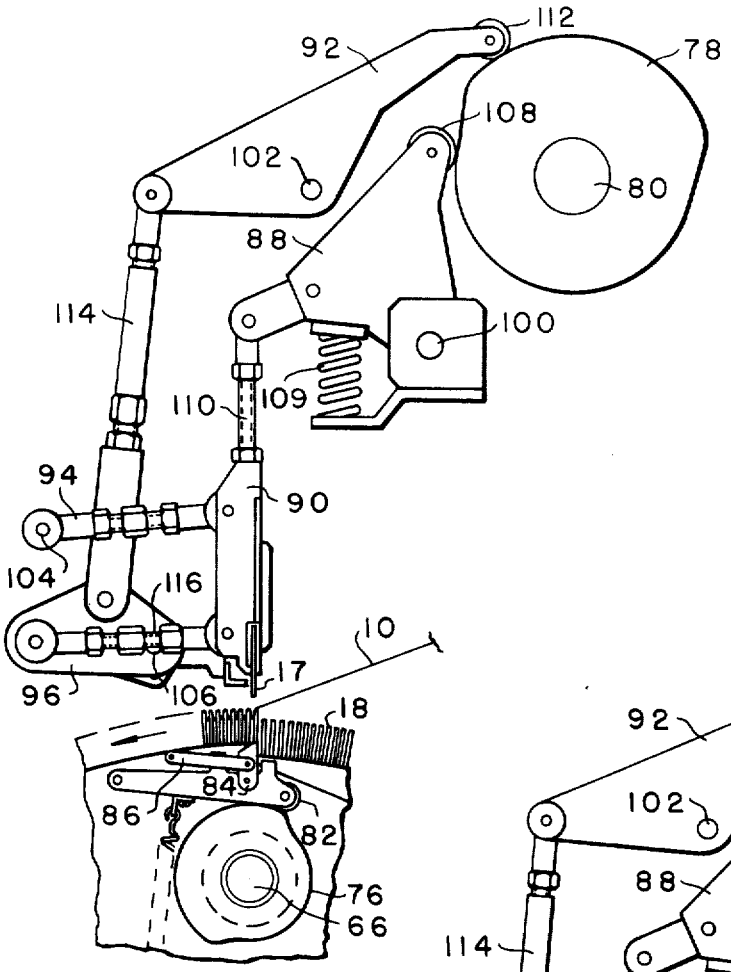
Figure 7:
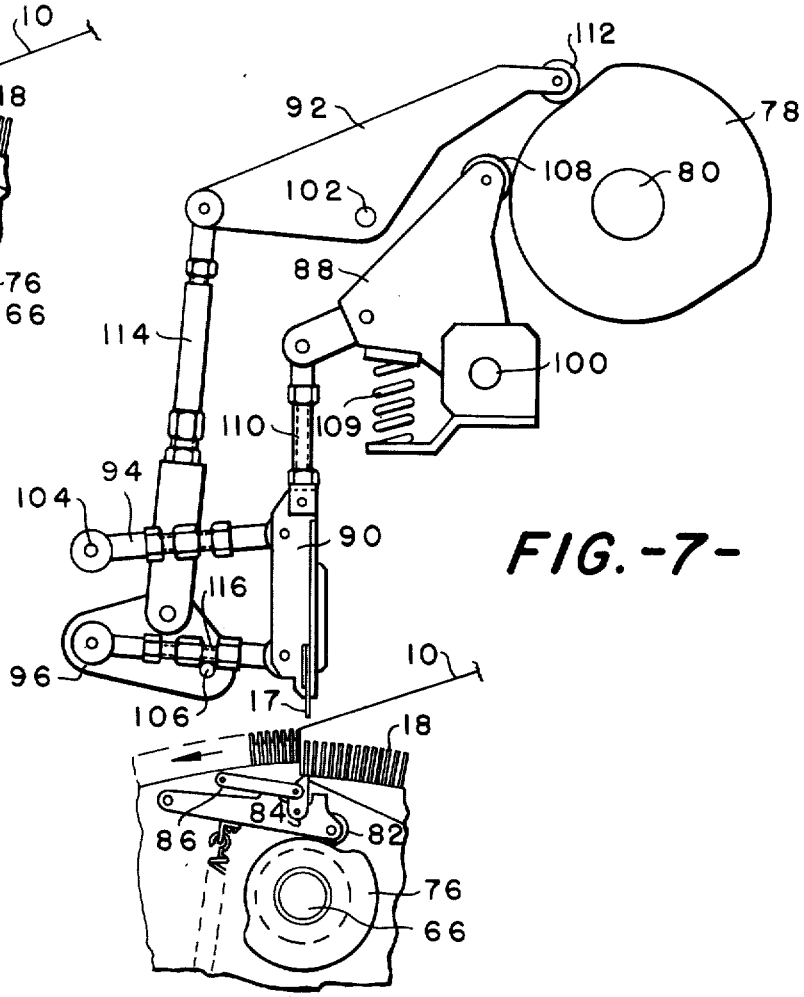

FIGS. 5–7 along with FIG. 1 show the basic blade positions of the machine; and

Figure 8:
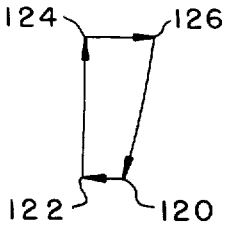

FIG. 8 is a schematic vector diagram of the blade positions.

Figure 3:
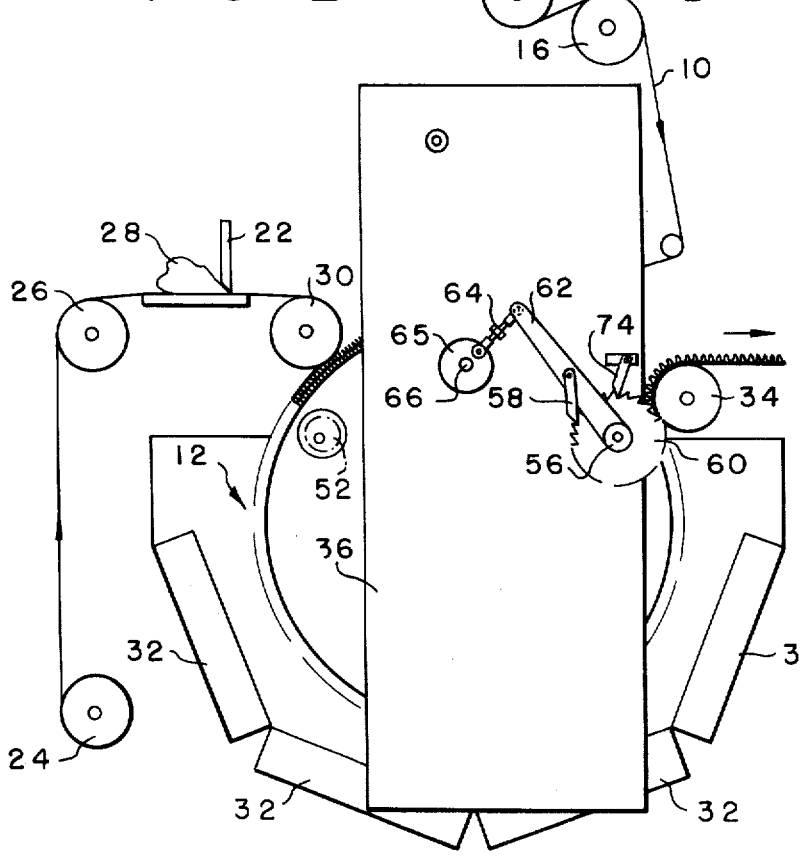
FIG. 3 is an elevation view taken on line 3—3 of FIG. 2.
Figure 4:
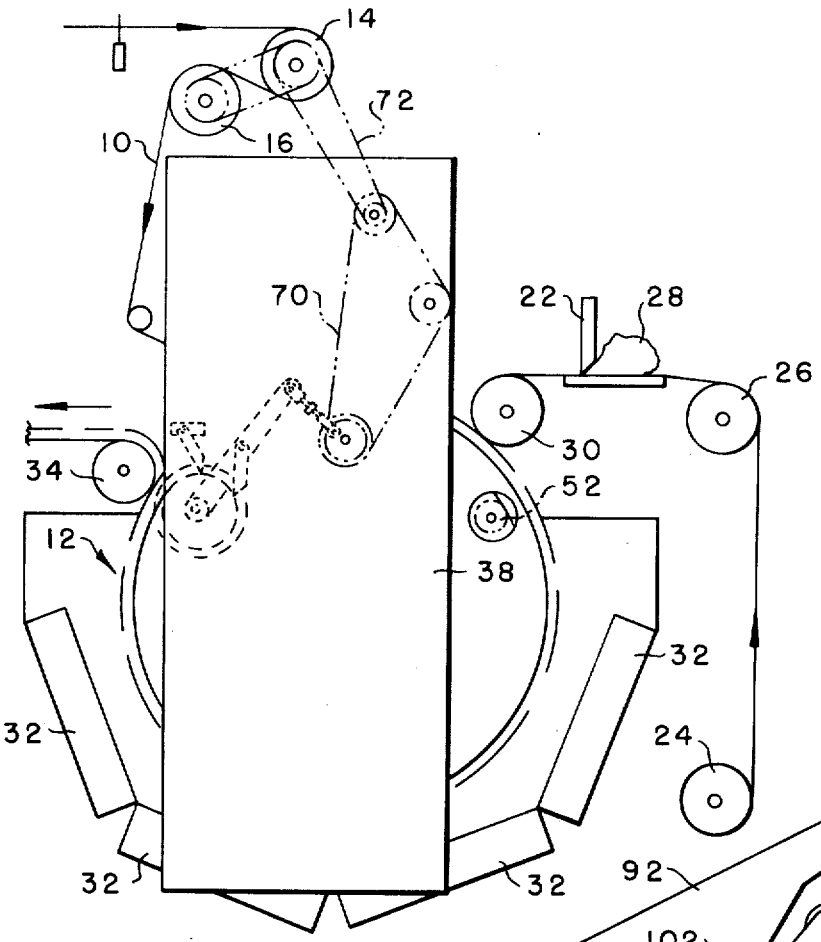
FIG. 4 is an elevation view taken on line 4—4 of FIG. 2.

Looking at FIGS. 1, 3 and 4, the overall concept will be explained. A plurality of yarn ends 10 is supplied from a warp beam or creel (not shown) to the rotor 12 over a pair of rolls 14 and 16. At the rotor, upper blade 17 cooperates with the lower blades 18 to insert the yarn in loops between the lower blades 18. The rotor is rotated counterclockwise and the loops are inserted into a suitable adhesive, such as polyvinyl chloride, placed on a backing sheet 20 by the doctor blade 22. The backing sheet is supplied from a roll 24, over a roll 26 to the adhesive station 28 and then over pressure roll 30 to a position against the top of loops. The backing sheet with the loops thereattached continues to rotate counterclockwise past the infrared electric heaters 32 to set the bond between the loops and the backing sheet. The bonded carpet is then doffed over roll 34 and delivered to the take-up roll (not shown).

The rotor 12 is supported between sides plates 36 and 38 by cross supports 40 and 42 to which are attached a plurality of support plates 44 and 46. Rotably supported between the plates 44 and 46 are blade support rings 48 which are held in position by drive gear 50 and idler gears 52 and 54 which are mounted on one of the plates 44 and 46 and engage the toothed inner surface of the rings 48. Each of the blade support rings 48 has a plurality of notches cut in the outer surface thereof to slidably support the lower blades 18. The lower blades are held in the notches by suitable means such as springs (not shown).

The driven gears 50 are rigidly secured to a rotably mounted shaft 56 which is intermittently rotated by the action of the pawl 58 against the ratchet 60 mounted on one end of shaft 56. The pawl 58 is pivotally mounted and actuated by the crank arm 62 which is rotated by the lever 64 connected to the crank 65. Crank 65 is mounted on shaft 66 supported by bearings 68 in the plates 44 and 46 and is driven by chain 70 which is driven from a drive source (not shown) by chain 72. A second pawl 74 is pivotally mounted adjacent the ratchet 60 to prevent back lash of the ratchet.

Also mounted on the shaft 66 between adjacent pairs of plates 44, 46 are cams 76 to periodically actuate the blades 18. Another set of cams 78 is mounted on shaft 80 which is also driven by chain 70 in timed relation so that the cams 76 and 78 rotate in a one-to-one ratio.

Each of the cams 76 have a spring loaded follower 82 operably associated therewith to slide upwardly one of the lower blades 18 at a predetermined time. The follower causes the pivotally mounted arm 84 to move upwardly to engage the blade 18. Another lever 86 is pivotally connected to cause the arm 84 to move in a substantially perpendicular direction to raise the blade 18 straight up.

Cams 78 are operably associated with a follower arm 88 pivotally connected to the frame of the machine to raise and lower the upper blade holder 90 and a follower arm 92 to adjust the position of the blade holder 90. Follower arms 88 and 92, as well as lever arm 94 and lever plate 96, are pivotally secured to the fixed support plates 98, respectively, at 100, 102, 104 and 106. Follower arm 88 has a follower 108 at one end biased by spring member 109 into engagement with the cam 78 and is pivotally connected to the connecting rod 110. Connecting rod 110 is pivotally connected to the blade holder 90. Follower arm 92 has a follower 112 at one end in engagement with the cam 78 and a connecting rod 114 pivotally secured thereto at the other end. Connecting rod 114 is pivotally secured to lever plate 96 at the other end. Both lever arms 94 and 116 are pivotally connected to blade holder 90 for reasons hereinafter explained. Lever arm 116 is pivotally connected at the other end to lever plate 96.

FIG. 8 schematically represents the positions of the upper blade member 17 shown in FIGS. 1 and 5–7. Reference numerals 120, 122, 124 and 126 represent respectively the upper blade position shown in FIGS. 1 and 5–7.

FIG. 1 represents the position indicated at 120 in FIG. 8 where the blade 17 has moved from the outward position 126 downward in a slightly curved angular path to bend the yarn 10 over the blade 18′. Then as the cams 76 and 78 continue to rotate clockwise, follower 112 pivots the follower arm 92 counterclockwise to move the lever 114 downward to pull the lever 116 slightly to the left to pack the yarn loop against the blade 18′ as shown in FIG. 5 and at reference point 122 in FIG. 8 and then the next adjacent lower blade 18 is projected upwardly by the arm 84 to bend another portion of the yarn 10 to form a loop in the yarn. Then as the cams 76 and 78 continue to rotate, the arm 84 maintains the blade 18 in the upward position while the follower 108 drops onto the low surface of the cam 78 to allow the spring 109 to pivot the follower arm 88 clockwise to pull the blade holder 90 with blade 17 attached thereto straight upward to the position indicated in FIG. 6 and reference point 124 in FIG. 8. Then as the cams 76 and 78 continue to rotate, the blade 17 will remain in the up position but will be moved horizontally to position 126 by the action of the cam 78 on the follower arm 92 to pull the lever 114 upward to pivot lever plate 96 to cause lever 116 to push the blade holder 90 to right (FIG. 7). At the same time ratchet 58 and pawl 60 have been actuated to index the rotor counterclockwise to the next position to form the next loop. Then the above described operation is repeated to continuously form rows of loops between adjacent blades 18.

It should be understood that a plurality of plates 98, cams 78 and associated linkages are spaced across the width of the rotor to provide uniform motion of the blade 17 and associated holder 90.

It should be noted that only half the yarn loop is being formed at any one time, thereby reducing the frictional forces on the yarn between the blade 18 and the yarn. This results, necessarily, in a reduction in the amount of force necessary by the blades 17 and 18 to form the yarn loops.

In the preferred embodiment the rotor 12 is stopped when the blades 17 and 18 are forming the loops and then the rotor is indexed to the next loop forming position but such motion is not mandatory. It is contemplated that the motion of the rotor could be continuous and the blade holder 90 could move therewith in a manner as shown in U.S. Pat. No. 3,385,747 wherein the motion of the top blade is synchronized with the motion of a rotor by having the angular velocity of the blade holder equal to the angular velocity of the rotor during a portion of the loop forming period.

Although we have described specifically the preferred embodiment of our invention we contemplate that changes may be made without departing from the scope or spirit of our invention and we desire to be limited only by the claims.

That which is claimed is:

1. A method of producing a textile fabric having an upper movable blade and a lower set of movable blades comprising the steps of: providing a supply of yarn, moving one of the lower blades upwardly, maintaining the lower edge of the upper blade substantially parallel to the upper edge of the lower blades while moving the upper movable blade downward in a curved angular path against the yarn and bending the yarn over the upwardly moved lower blade, moving the upper blade sideways against the yarn to pack the yarn against one of the lower blades, moving the next adjacent lower blade upwardly against the yarn and bending the yarn over the upper blade to form a loop therein, supplying a backing sheet and adhering the formed yarn loop to the backing sheet.

2. Apparatus to produce a bonded pile fabric comprising: a rotor, means to rotate said rotor, a set of blade members slidably mounted in said rotor, means to slide one blade of said set of blades upwardly, a second blade member movably mounted with respect to said rotor and operably associated with said blade members in said rotor, means to supply yarn between said set of blade members and said second blade member, means to maintain the lower edge of the upper blade substantially parallel to the upper edge of the lower blades while moving said second blade member downwardly toward and at an angle to said one blade of said set of blade members to bend the yarn over said one blade of said set of blade members, means to then move said second blade member toward the first mentioned one blade of said set of blade members to pack the yarn thereagainst, means to slide upwardly the blade of said set of blade member next adjacent to the blade over which the yarn is bent to form a loop in said yarn, and means to supply an adhesive backed backing material into contact with said formed loop.

3. The apparatus of claim 2 wherein the means to move the second blade and said blade in said set of blades includes a cam.

4. The apparatus of claim 2 wherein said rotor includes a plurality of rings with a plurality of notches in the outer surface thereof, said blade members of said set of blade members being supported in said notches.

* * * * *